US010941639B2

(12) United States Patent
Al-Gouhi

(10) Patent No.: US 10,941,639 B2
(45) Date of Patent: Mar. 9, 2021

(54) MULTI-STAGE HYDROCARBON LIFTING

(71) Applicant: Saudi Arabian Oil Company, Dhahran (SA)

(72) Inventor: Al-Waleed Abdullah Al-Gouhi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 36 days.

(21) Appl. No.: 16/360,342

(22) Filed: Mar. 21, 2019

(65) Prior Publication Data

US 2019/0316451 A1 Oct. 17, 2019

Related U.S. Application Data

(60) Provisional application No. 62/656,688, filed on Apr. 12, 2018.

(51) Int. Cl.
*E21B 34/08* (2006.01)
*F04F 1/12* (2006.01)
(Continued)

(52) U.S. Cl.
CPC ..... *E21B 43/123* (2013.01); *E21B 34/08* (2013.01); *E21B 47/008* (2020.05); *E21B 47/06* (2013.01); *E21B 2200/04* (2020.05)

(58) Field of Classification Search
CPC ..... E21B 43/121; E21B 43/13; E21B 43/123; E21B 43/1235; E21B 43/166; E21B 43/168; E21B 34/08; F04F 1/12
See application file for complete search history.

(56) References Cited

U.S. PATENT DOCUMENTS 1,294,069 A 2/1919 English
1,390,085 A * 9/1921 Salvatore ..... F04B 47/00 417/121
(Continued)

FOREIGN PATENT DOCUMENTS

WO 9964742 12/1999

OTHER PUBLICATIONS petrowiki.org' [online], "Plunger Lift," PetroWiki, SPE International, available on or before Jun. 30, 2015, retrieved on Apr. 5, 2019, retrieved from URL <https://petrowiki.org/Plunger_lift>, 6 pages.
(Continued)

*Primary Examiner* — Catherine Loikith
(74) *Attorney, Agent, or Firm* — Fish & Richardson P.C.

(57) ABSTRACT

A production tubing is disposed in a wellbore formed in a subterranean zone. The production tubing extends from a surface of the wellbore to a downhole location at which hydrocarbons entrapped in the subterranean zone enter the wellbore. Multiple valves are disposed in the production tubing at respective multiple tubing locations. Each valve is configured to permit one-way flow of hydrocarbons in an uphole direction. The multiple valves divide the production tubing into multiple stages. A stage is a portion of the production tubing between two successively disposed valves. Multiple gas injection valves are coupled to the production tubing and are disposed in a respective stage. A controller, coupled to the multiple valves and the multiple gas injection valves, transmits signals to the multiple valves and the multiple gas injection valves to lift hydrocarbons flowed into the wellbore at the downhole location to the surface on a stage-by-stage basis.

20 Claims, 11 Drawing Sheets

(51) Int. Cl.

| | |
|---|---|
| ***E21B 43/12*** | (2006.01) |
| ***E21B 47/06*** | (2012.01) |
| ***E21B 47/008*** | (2012.01) |

(56) References Cited

U.S. PATENT DOCUMENTS

| | | | | | |
|---|---|---|---|---|---|
| 2,016,433 | A | | 10/1935 | Humason | |
| 2,131,183 | A | * | 9/1938 | Key | F04F 1/12 417/121 |
| 2,864,317 | A | * | 12/1958 | Robinson | F04F 1/18 417/90 |
| 3,736,983 | A | | 6/1973 | Beard et al. | |
| 4,653,989 | A | * | 3/1987 | Mason | F04B 47/12 166/67 |
| 6,435,838 | B1 | * | 8/2002 | Marvel | E21B 43/121 417/12 |
| 6,558,128 | B2 | * | 5/2003 | Marvel | E21B 43/121 417/121 |
| 6,672,392 | B2 | | 1/2004 | Reitz | |
| 6,810,961 | B2 | * | 11/2004 | Marvel | E21B 43/121 166/107 |

OTHER PUBLICATIONS petrowiki.org' [online], "Gas Lift," PetroWiki, SPE International, available on or before Jul. 1, 2015, retrieved on Apr. 5, 2019, retrieved from URL <https://petrowiki.org/Gas_lift>, 4 pages.

International Search Report and Written Opinion issued in International Application No. PCT/US2019/025280 dated Jul. 12, 2019, 13 pages.

* cited by examiner

MULTI-STAGE HYDROCARBON LIFTING

CROSS-REFERENCE TO RELATED APPLICATIONS

This application claims priority to U.S. Application Ser. No. 62/656,688 filed on Apr. 12, 2018, the entire contents of which is incorporated herein by reference.

TECHNICAL FIELD

This disclosure relates to producing hydrocarbons, for example, oil, gas or combinations of them, through wellbores.

BACKGROUND

Hydrocarbons, for example, oil, gas, combinations of them, or other hydrocarbons, can be entrapped in subterranean zones, which can include a formation, multiple formation or portions of a formation. Wellbores can be drilled in the subterranean zone to recover entrapped hydrocarbons. A primary recovery technique to recover the entrapped hydrocarbons is based on a natural pressure exerted by the subterranean zone. The natural pressure causes the hydrocarbons to flow into a wellbore and to a surface of the wellbore. Over time, however, the natural pressure can decrease. In such situations, secondary recovery techniques can be implemented to flow (that is, to lift or raise) the hydrocarbons to the surface. Some examples of secondary recovery techniques can include the use of electric submersible pumps (ESPs) that can receive the hydrocarbons at a downhole (or upstream) location and flow the hydrocarbons to an uphole (or downstream) location.

SUMMARY

This disclosure describes technologies relating to hydrocarbon lifting through the wellbore.

Certain aspects of the subject matter described here can be implemented as a method. A production tubing is disposed in a wellbore formed in a subterranean zone. The production tubing extends from a surface of the wellbore to a downhole location in the wellbore at which hydrocarbons entrapped in the subterranean zone enter the wellbore. Multiple valves are disposed in the production tubing at respective multiple tubing locations. Each valve is configured to permit one-way flow of hydrocarbons in and uphole direction. The multiple valves divide the production tubing into multiple stages. A stage is a portion of the production tubing between two successively disposed valves. A presence of hydrocarbons in a first stage terminating at a first valve is determined. In response to determining the presence of hydrocarbons in the first stage, gas is injected into the first stage causing the hydrocarbons in the first stage to flow uphole through the first valve into a second stage uphole of the first stage. It is determined that the second stage is filled with the hydrocarbons flowed uphole through the first valve from the first stage. In response to determining that the second stage is filled with the hydrocarbons, injection of the gas into the first stage is ceased.

Additional aspects combinable with one or more of any of the other aspects described here can include the following features. In response to determining that the second stage is filled with the hydrocarbons, gas is injected into the second stage causing the hydrocarbons in the second stage to flow uphole through the second valve into a third stage uphole of the second stage. The third stage terminates at a third valve. It is determined that the third stage is filled with the hydrocarbons flowed uphole through the second valve from the second stage. In response to determining that the third stage is filled with the hydrocarbons, injection of the gas into the second stage is ceased.

Additional aspects combinable with one or more of any of the other aspects described here can include the following features. Multiple pressure gauges are disposed in the respective multiple stages. To determine the presence of hydrocarbons in the first stage, a first pressure gauge disposed in the first stage senses a fluidic pressure by the hydrocarbons in the first stage.

Additional aspects combinable with one or more of any of the other aspects described here can include the following features. To inject the gas into the first stage, the gas is injected for a first duration of time sufficient to flow the hydrocarbons in the first stage uphole through the first valve into the second stage.

Additional aspects combinable with one or more of any of the other aspects described here can include the following features. To determine that the second stage is filled with the hydrocarbons flowed uphole through the first valve from the first stage, a presence of hydrocarbons in a third stage uphole of the second stage and terminating at a third valve is determined.

Additional aspects combinable with one or more of any of the other aspects described here can include the following features. A pressure gauge is disposed in the third stage uphole of the second valve. To determine the presence of hydrocarbons in the third stage, the pressure gauge disposed in the third stage senses a fluidic pressure caused by hydrocarbons flowed from the second stage through the second valve into the third stage.

Additional aspects combinable with one or more of any of the other aspects described here can include the following features. The aspects described above can be repeated until the hydrocarbons in the first stage are flowed out of the wellbore at the surface. The aspects described above can be repeated to lift newly accumulated hydrocarbons in the first stage to the surface.

Certain aspects of the subject matter described here can be implemented as a wellbore tool system. A production tubing is disposed in a wellbore formed in a subterranean zone. The production tubing extends from a surface of the wellbore to a downhole location in the wellbore at which hydrocarbons entrapped in the subterranean zone enter the wellbore. Multiple valves are disposed in the production tubing at respective multiple tubing locations. Each valve is configured to permit one-way flow of hydrocarbons in an uphole direction. The multiple valves divide the production tubing into multiple stages. A stage is a portion of the production tubing between two successively disposed valves. Multiple gas injection valves are coupled to the production tubing. Each gas injection valve is disposed in a respective stage. A controller is coupled to the multiple valves and the multiple gas injection valves. The controller is configured to transmit signals to the multiple valves and the multiple gas injection valves to lift hydrocarbons flowed into the wellbore at the downhole location to the surface on a stage-by-stage basis.

Additional aspects combinable with one or more of any of the other aspects described here can include the following features. To lift the hydrocarbons to the surface on a stage-by-stage basis the controller is configured to perform the following operations. The controller determines a presence of hydrocarbons in a first stage terminating at a first valve. In response to determining the presence of hydrocarbons in the first stage, the controller causes gas to be injected into the first stage causing the hydrocarbons in the first stage to flow uphole through the first valve into a second stage uphole of the first stage. The second stage terminates at a second valve. The controller determines that the second stage is filled with the hydrocarbons flowed uphole through the first valve from the first stage. In response to determining the presence of hydrocarbons in the third stage, the controller causes gas injection into the first stage to be ceased.

Additional aspects combinable with one or more of any of the other aspects described here can include the following features. Multiple pressure gauges are disposed in the respective multiple stages. To determine the presence of hydrocarbons in the first stage, a first pressure gauge disposed in the first stage senses a fluidic pressure by the hydrocarbons in the first stage.

Additional aspects combinable with one or more of any of the other aspects described here can include the following features. To cause gas to be injected into the first stage, the controller causes the gas to be injected for the first duration of time sufficient to flow the hydrocarbons in the first stage uphole through the first valve into the second stage.

Additional aspects combinable with one or more of any of the other aspects described here can include the following features. To determine that the second stage is filled with the hydrocarbons flowed uphole through the first valve from the first stage, the controller can determine a presence of hydrocarbons in a third stage uphole of the second stage and terminating at a third valve.

Additional aspects combinable with one or more of any of the other aspects described here can include the following features. A pressure gauge is disposed in the third stage uphole of the second valve. To determine the presence of hydrocarbons in the third stage, the pressure gauge disposed in the third stage senses a fluidic pressure caused by hydrocarbons flowed from the second stage through the second valve into the third stage.

Additional aspects combinable with one or more of any of the other aspects described here can include the following features. The controller is configured to cause the operations described here to be repeated until the hydrocarbons in the first stage are flowed out of the wellbore at the surface.

Certain aspects of the subject matter described here can be implemented as a method. A production tubing is disposed in a wellbore formed in a subterranean zone. The production tubing extends from a surface of the wellbore to a downhole location in the wellbore at which hydrocarbons entrapped in the subterranean zone enter the wellbore. Multiple valves are disposed in the production tubing at respective multiple tubing locations. Each valve is configured to permit one-way flow of hydrocarbons in an uphole direction. The multiple valves divide the production tubing into multiple stages. A stage is a portion of the production tubing between two successively disposed valves. Gas is injected into a first stage carrying hydrocarbons causing the hydrocarbons to flow into a second stage uphole of the first stage. Gas injection into the first stage is ceased in response to determining that the hydrocarbons flowed to the second stage. After ceasing gas injection into the first stage, gas is injected into the second stage causing the hydrocarbons to flow into a third stage uphole of the second stage.

Additional aspects combinable with one or more of any of the other aspects described here can include the following features. Before injecting the gas into the first stage, it is determined that the hydrocarbons are carried by the first stage.

Additional aspects combinable with one or more of any of the other aspects described here can include the following features. To determine that the hydrocarbons are carried by the first stage, a fluidic pressure of the hydrocarbons in the first stage is sensed.

Additional aspects combinable with one or more of any of the other aspects described here can include the following features. A flow back of the hydrocarbons from the second stage to the first stage is prevented after ceasing to inject the gas into the first stage.

Additional aspects combinable with one or more of any of the other aspects described here can include the following features. A first valve at which the first stage terminates prevents the flow back of the hydrocarbons from the second stage to the first stage.

Additional aspects combinable with one or more of any of the other aspects described here can include the following features. Gas is injected into the multiple stages on a stage-by-stage basis to flow the hydrocarbons to the surface of the wellbore.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a multi-stage lifting process to lift hydrocarbons in a subterranean zone to a surface of a wellbore formed in the subterranean zone. For example, techniques described in this disclosure can be implemented in a producing oil well drilled into a deep reservoir with low reservoir productivity index. Reservoir productivity index is the volume of hydrocarbons delivered per unit pressure (pounds per square inch) of drawdown at the sand face. Reservoir productivity index can be measured in barrels per day per psi (bbl/d/psi). As described below, a production tubing disposed in a wellbore is divided into multiple stages. Each stage is equipped with valves, a gas lift electrical valve and a pressure sensor or pressure gauge. The hydrocarbons at a downhole location are produced on a stage-by-stage basis. That is, the hydrocarbons are lifted from the downhole location to the surface, one stage at a time. In some implementations, the valves can be bore isolation valves that can be actively controlled, for example, hydraulically or electrically, from the surface or from within the wellbore to open or close responsive to signals from a controller (described later). In some implementations, the valves can be check valves that can open or close based on flow direction. For example, the check valves can be ball and seat valves or flapper valves. Such valves are passive. That is, they do not require signals to open or close; rather, they open or close based on flow direction.

Implementations of the subject matter described here can prevent hydrocarbons from falling back, that is, flowing downhole from an uphole location, due to loss of pressure in conventional gas lift operations. The gas volume used to lift the hydrocarbons can be reduced compared to conventional gas lift operations. The depth challenge encountered in sucker rod pump technology can be decreased or overcome. Also, the challenge associated with wellbore angle deviation, which prevents the application of plunger lift technology, can also be decreased or overcome.

Figure 1A:
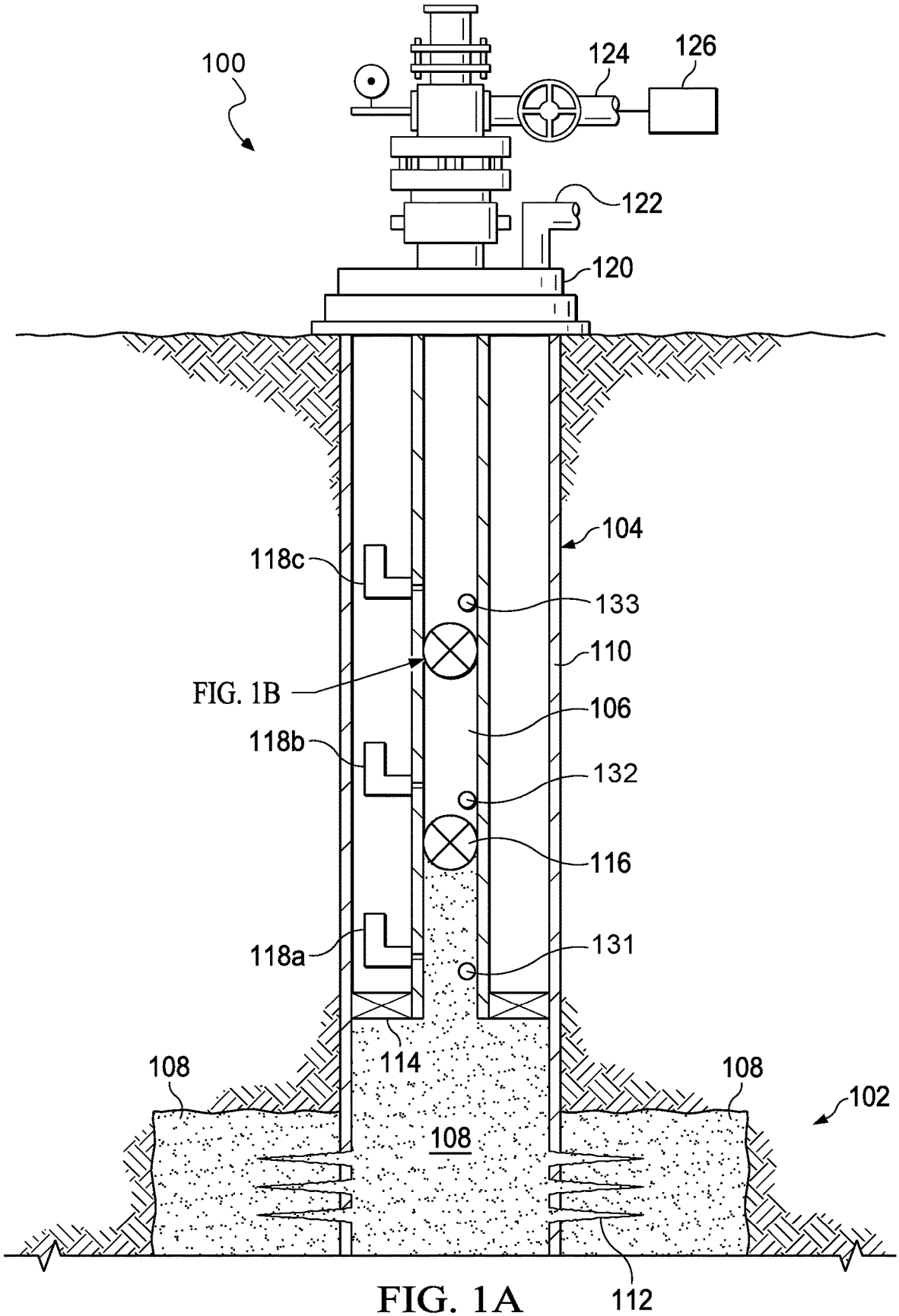
FIG. 1A is a schematic of an example of a wellbore tool system.

FIG. 1A is a schematic of an example of a wellbore tool system 100 to lift hydrocarbons entrapped in a subterranean zone 102. The subterranean zone 102 can be a formation, a portion of a formation or multiple formations. Hydrocarbons are entrapped in the subterranean zone 102. A wellbore 104 is formed in the subterranean zone 102. Production tubing 106 is disposed in the wellbore 104 in the subterranean zone 102. Hydrocarbons 108 can enter the wellbore 104 from the subterranean zone 102. In some implementations, the wellbore 104 can be cased and can include a casing 110. The cased portion (and consequently the casing 110) can span all or portions of the wellbore 104. In some implementations, perforations 112 can be formed in the casing 110 to receive the hydrocarbons 108 from the subterranean zone 102. The production tubing 106 can be disposed within the casing. Alternatively, the hydrocarbons 108 can flow into an open portion of the wellbore 104 and be received at a downhole end of the casing 110. In some implementations, an isolation mechanism 114, for example, a packer, can be installed at a downhole end of the production tubing 106 so that the hydrocarbons 108 flow into the production tubing 106 rather than into an annulus formed by the casing 110 and the production tubing 106 or by the wellbore 104 and the production tubing 106.

Figure 1B:
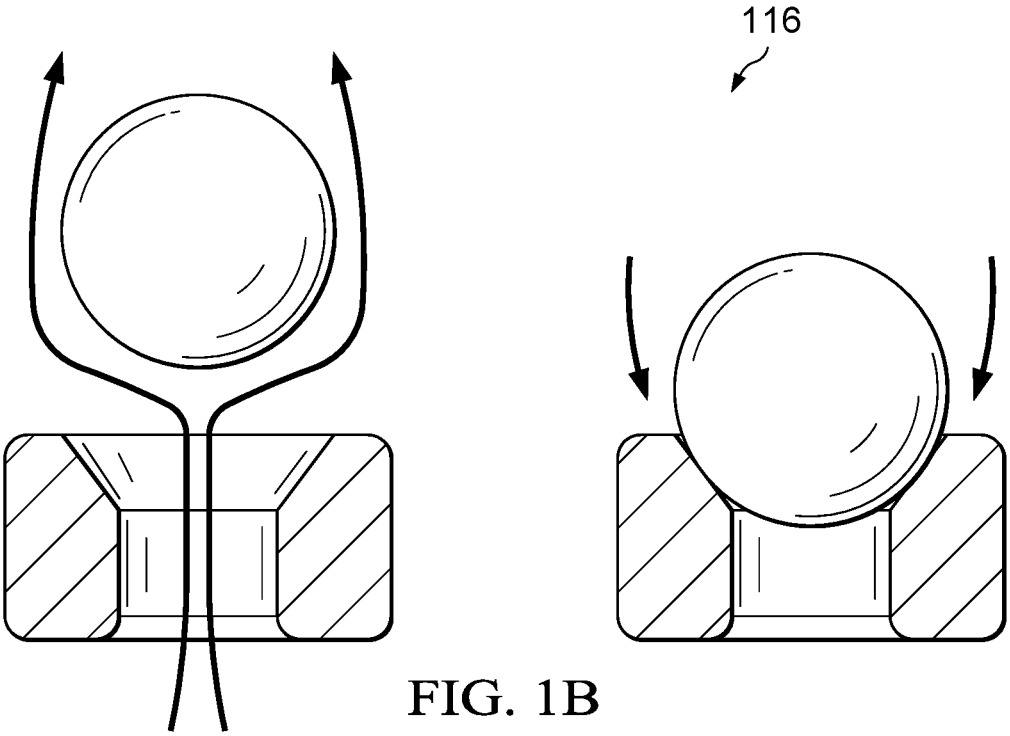
FIG. 1B is a schematic of an example of a valve used in the wellbore tool system.

The wellbore tool system includes multiple valves (for example, valve 116) disposed in the production tubing 106 at respective multiple tubing locations. Each valve 116 permits one-way flow of hydrocarbons in an uphole direction. FIG. 1B is a schematic of an example of a valve 116 used in the wellbore tool system 100. The valve 116 can be a check valve that includes a ball on a seat. When hydrocarbons flow through the check valve in an uphole direction, the ball is raised from the seat in response to a fluidic pressure of the hydrocarbons being sufficient to raise the ball from the seat. When the fluidic pressure of the hydrocarbons decreases, the ball returns to the seat sealing the flow in the uphole direction. Flow of the hydrocarbons in the downhole direction is prevented by the ball being pressed against the seat in response to a fluidic pressure in the downhole direction.

The multiple valves can be disposed to divide the production tubing 106 into multiple stages. A stage is a portion of the production tubing 106 between two successively disposed valves. In some implementations, the valves can be disposed such that the stages can have equal lengths. Alternatively, the valves can be disposed such that one stage can be longer than the other. In another implementation, some stages can be of equal length while others can be of different length. The length of each stage can depend on factors including the depth of the wellbore, the bottomhole pressure at the downhole location in the wellbore, a volume of hydrocarbons to be lifted, among others.

Multiple gas injection valves (for example, a first gas injection valve 118*a*, a second gas injection valve 118*b*, a third injection valve 118*c*) can be coupled to the production tubing 106. Each gas injection valve is disposed in a respective stage. In some implementations, the gas injection valves can be disposed in an annulus formed by an outer surface of the production tubing 106 and the inner wall of the casing 110. In some implementations, a tubing (not shown) can be passed into the annulus, and the gas injection valves can be positioned in the tubing. An inlet 122 to flow gas can be provided at a surface of the wellbore 104 (for example, at a wellhead 120). A hydrocarbon outlet 124 can be connected at the surface, for example, at the wellhead 120.

A controller 126 can be coupled to the multiple valves and the multiple gas injection valves. In some implementations, the controller 126 can be at the surface of the wellbore. In some implementations, the controller 126 can be disposed within the wellbore, for example, in the annulus formed by the production tubing 104 and the casing 110. In some implementations, the controller 126 can be implemented as a distributed computer system disposed partly at the surface and partly within the wellbore. The computer system can include one or more processors and a computer-readable medium storing instructions executable by the one or more processors to perform the operations described here. In some implementations, the controller 126 can be implemented as processing circuitry, firmware, software, or combinations of them. The controller 126 can transmit signals to the multiple valves and the multiple gas injection valves to lift hydrocarbons flowed into the wellbore at the downhole location to the surface on a stage-by-stage basis.

FIGS. 2A-2H are schematics showing example operations of the wellbore tool system 100 to lift hydrocarbons 108 on a stage-by-stage basis. The example wellbore tool system 100 shown in FIGS. 2A-2H are the same as that shown in FIG. 1A. The production tubing is divided into three stages. In the example shown in FIG. 2A, hydrocarbons 108 have flowed from the subterranean zone into the first stage (that is, the most downhole stage). In some implementations, the first stage can be fully filled with the hydrocarbons 108. That is, the hydrocarbons can have filled the first stage from the bottom of the first stage to the first valve that terminates the first stage. In some implementations, the first stage can be partially filled with the hydrocarbons 108.

The controller can determine a presence of the hydrocarbons 108 in the first stage. In some implementations, a pressure gauge 131, 132, and 133 can be disposed in each stage and be coupled to the controller. The pressure gauge can sense a fluidic pressure of the hydrocarbons in that stage and transmit the sensed pressure as a signal to the controller. The controller can determine that the stage is filled with a pre-determined quantity of hydrocarbons 108 based on the sensed pressure satisfying (for example, being greater than) a threshold fluidic pressure. In some implementations, the controller can determine that the pressure is satisfied in response to the pressure gauge sensing pressure for a threshold duration of time. Doing so ensures that the pressure gauge senses a large hydrocarbon column and not merely a small flow of hydrocarbons.

Figure 2A:
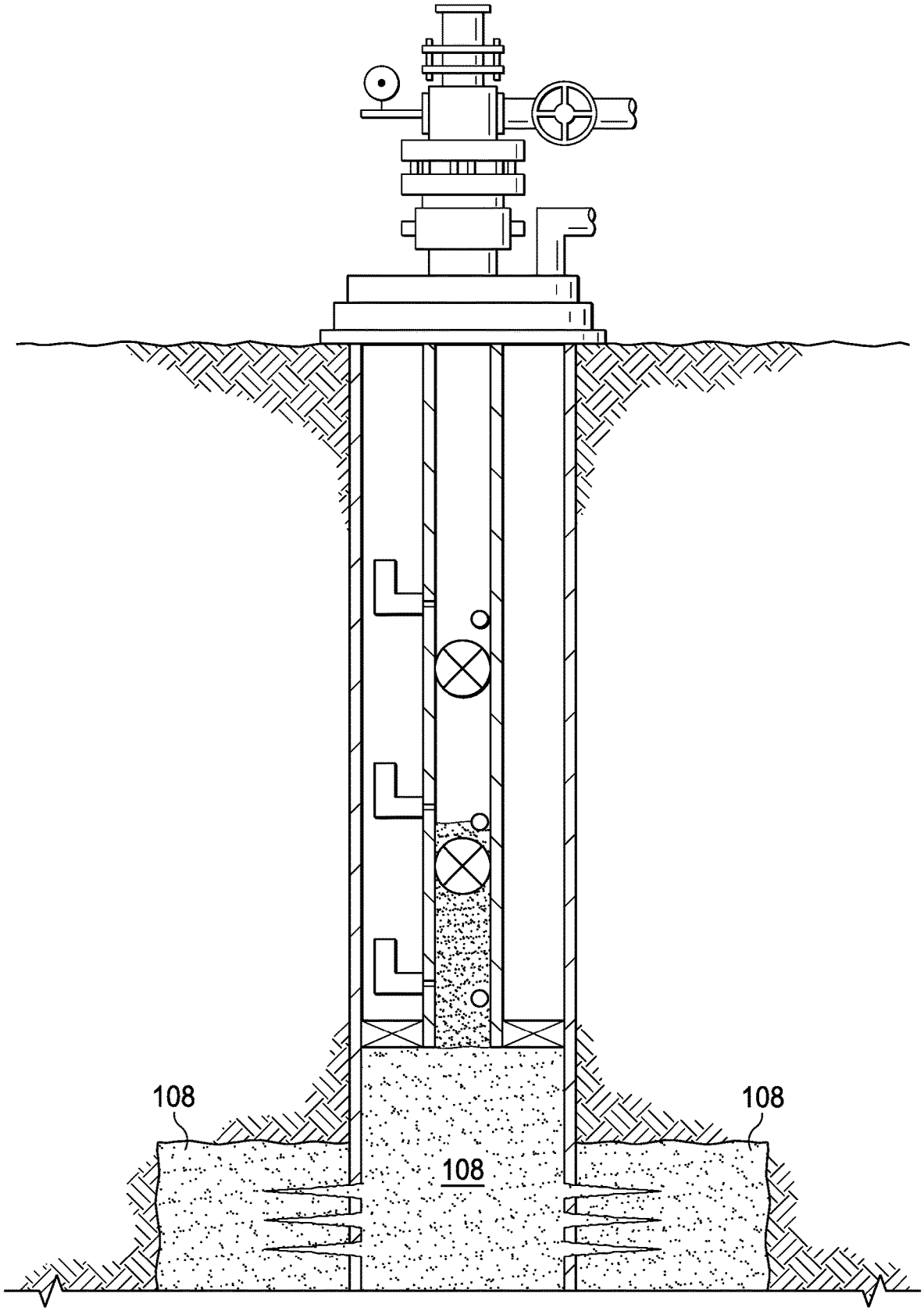
FIGS. 2A-2H are schematics showing example operations of the wellbore tool system to lift hydrocarbons.
Figure 2B:
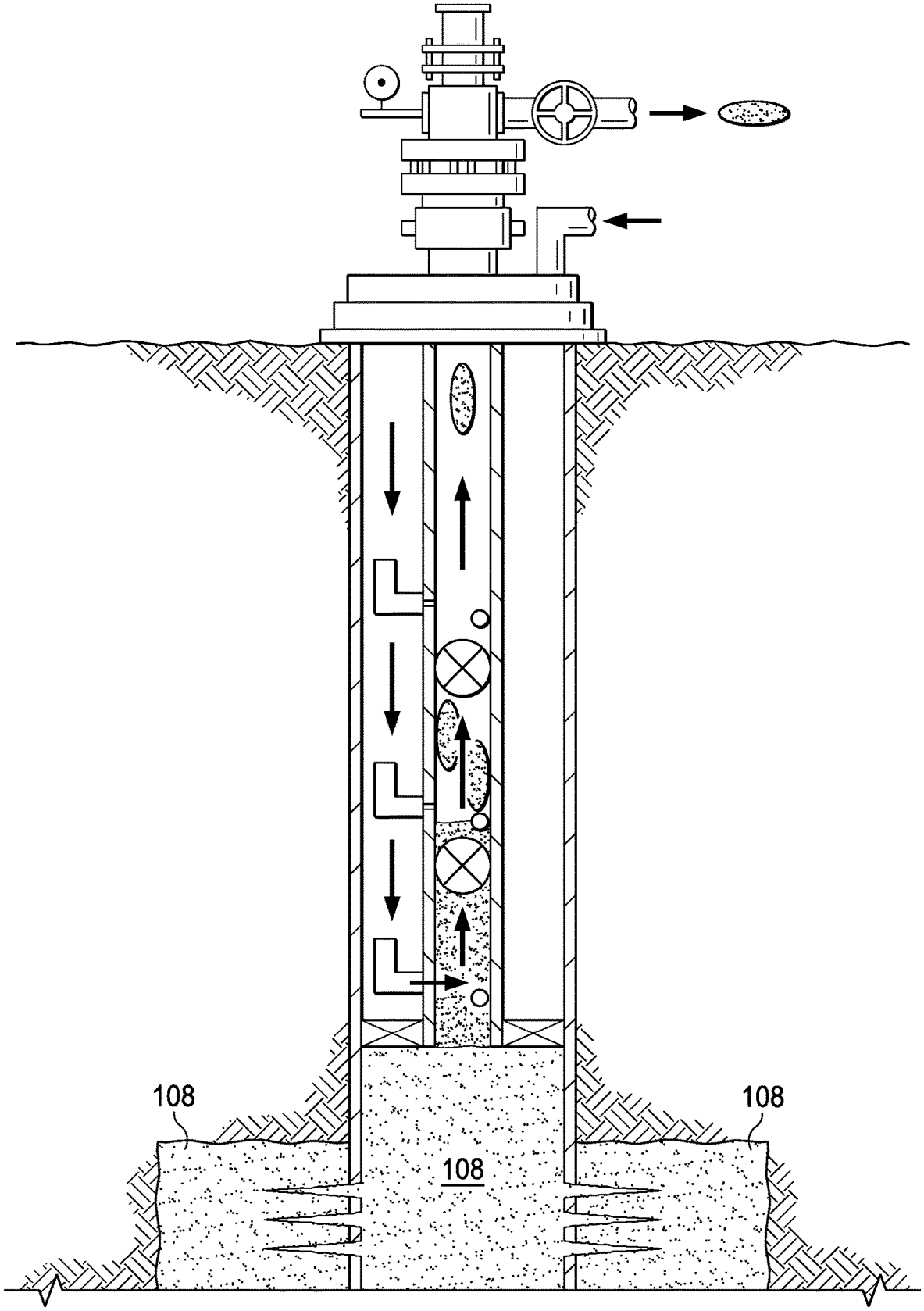

FIG. 2B shows a lifting of the hydrocarbons 108 in the first stage. In response to determining the presence of the hydrocarbons 108 in the first stage, the controller can inject gas into the gas injection valve coupled to the first stage. For example, the controller can transmit a signal to a gas source (for example, a pump coupled to a storage tank) to flow gas to the gas injection valve. At the same time, the controller can transmit a signal to open the gas injection valve. In some implementations, each gas injection valve can be connected to the bottom-most portion of a respective stage, that is, nearest to an entrance of the stage. The pressure of the gas causes the hydrocarbons 108 to rise uphole. When the rising hydrocarbons apply sufficient pressure on the first valve that terminates the first stage, the first valve opens allowing the hydrocarbons to flow uphole to the second stage.

Figure 2C:
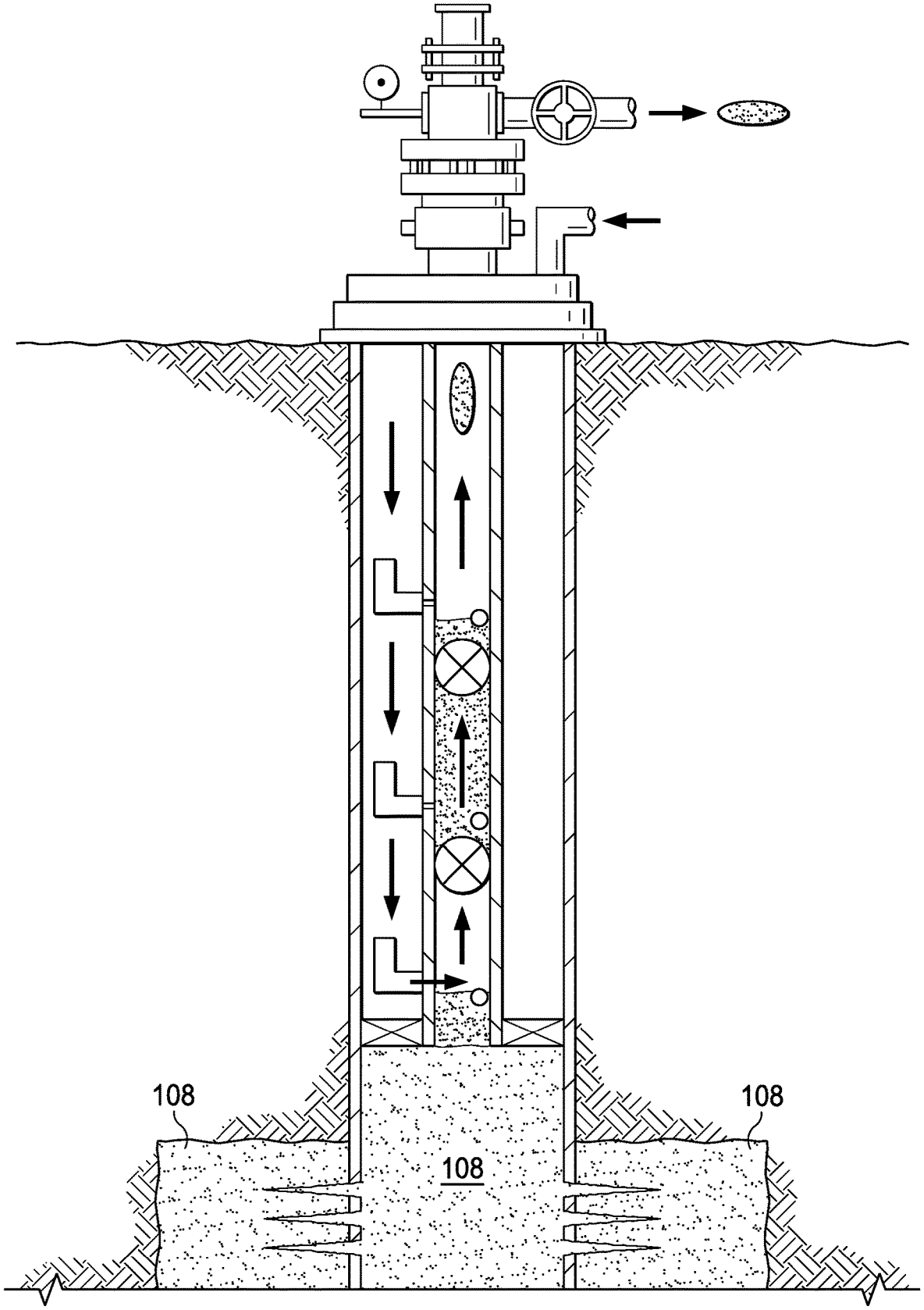

FIG. 2C shows the second stage filled with the hydrocarbons 108. As the hydrocarbons rise into the second stage, the second stage is filled with the hydrocarbons 108. In some implementations, a pressure gauge is installed in the second stage similar to the pressure gauge in the first stage. During this filling, the gas injection valve coupled to the first stage continues to inject gas into the first stage. In some implementations, the gas injection valve can continue the gas injection for a pre-determined time period, for example, a period sufficient to lift hydrocarbons of known volume by a known distance.

Figure 2D:
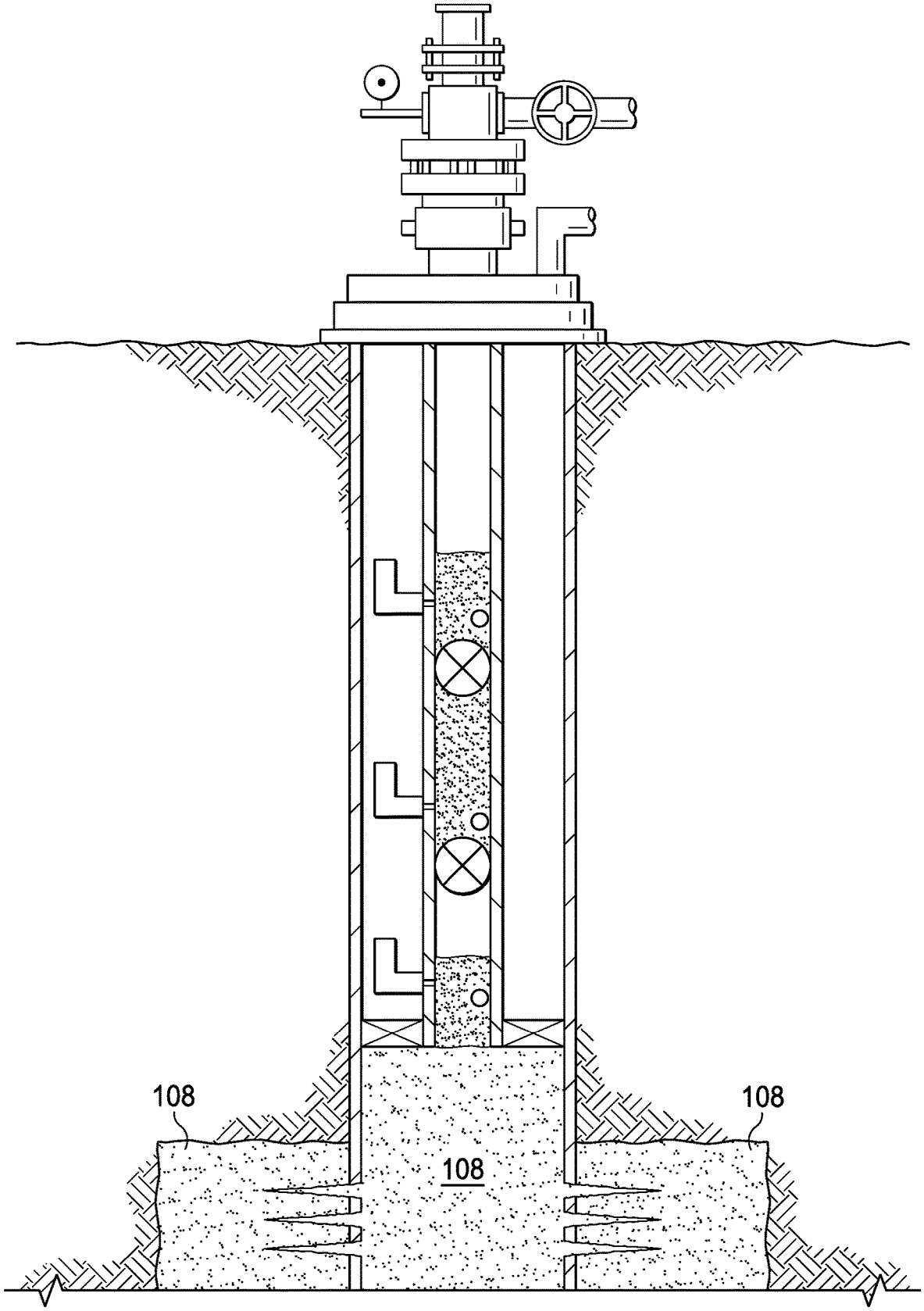

FIG. 2D shows a cessation of gas injection. After the second stage is filled with the hydrocarbons (partially or completely), the gas injection valve ceases to inject gas into the first stage. In some implementations, the controller can receive a signal from the pressure gauge positioned in the second stage, the signal representing a fluidic pressure in the second stage. The fluidic pressure is an indication of a volume or quantity of hydrocarbons in the second stage. In response to determining that the fluidic pressure sensed by the pressure gauge in the second stage satisfies (for example, is greater than), the controller transmits a signal to cease gas injection through the gas injection valve. Ceasing gas injection through the gas injection valve can be implemented by transmitting a signal to close the gas injection valve or to turn off the gas source or both. In some implementations, the gas source can remain on at all times and the controller can control gas injection by opening or closing the respective gas injection valves. In this manner, the column of hydrocarbons in the first stage (FIG. 2A) have been lifted to the second stage. Hydrocarbons continue to accumulate in the first stage from the subterranean zone.

Figure 2E:
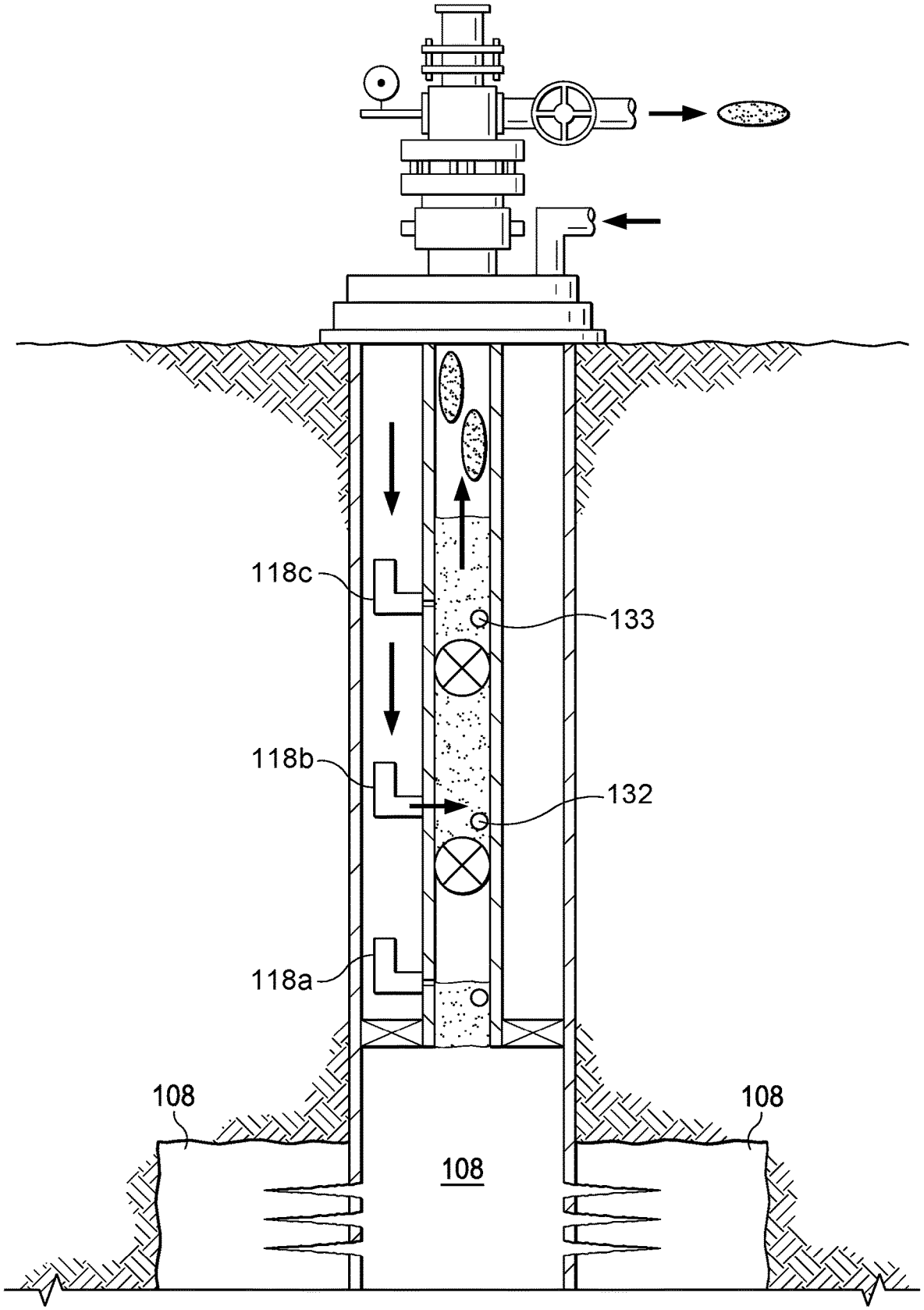

FIG. 2E shows lifting of hydrocarbons from the second stage to a third stage uphole of the second stage. In some implementations, the controller determines a presence of the hydrocarbons in the second stage based on a fluidic pressure sensed by the pressure gauge in the second stage. Alternatively or in addition, the controller determines the presence based on a fluidic pressure sensed by a pressure gauge in the third stage. For example, if the fluidic pressure sensed by the pressure gauge in the third stage is less than a threshold fluidic pressure, then the controller can determine that insufficient hydrocarbons are present in the second stage. After the second stage has filled, hydrocarbons flow uphole from the second stage into the third stage. Because the pressure gauge in the third stage is positioned near an entrance of the third stage, the hydrocarbons apply a fluidic pressure on the pressure gauge which transmits a signal representing the fluidic pressure to the controller. The presence of hydrocarbons in the third stage indicates that the second stage is filled (completely or partially) with hydrocarbons. In response, the controller implements techniques to raise the hydrocarbons from the second stage to the third stage.

The techniques that the controller implements to lift the hydrocarbons from the second stage to the third stage are the same as those that the controller implemented to lift the hydrocarbons from the first stage to the second stage. For example, the controller transmits a signal to open the gas injection valve connected to the second stage. The gas injection valves connected to the other stages remain closed. The valve that terminates the first stage prevents hydrocarbon flow in the downhole direction. The valve that terminates the second stage permits hydrocarbon flow in the uphole direction.

Figure 2F:
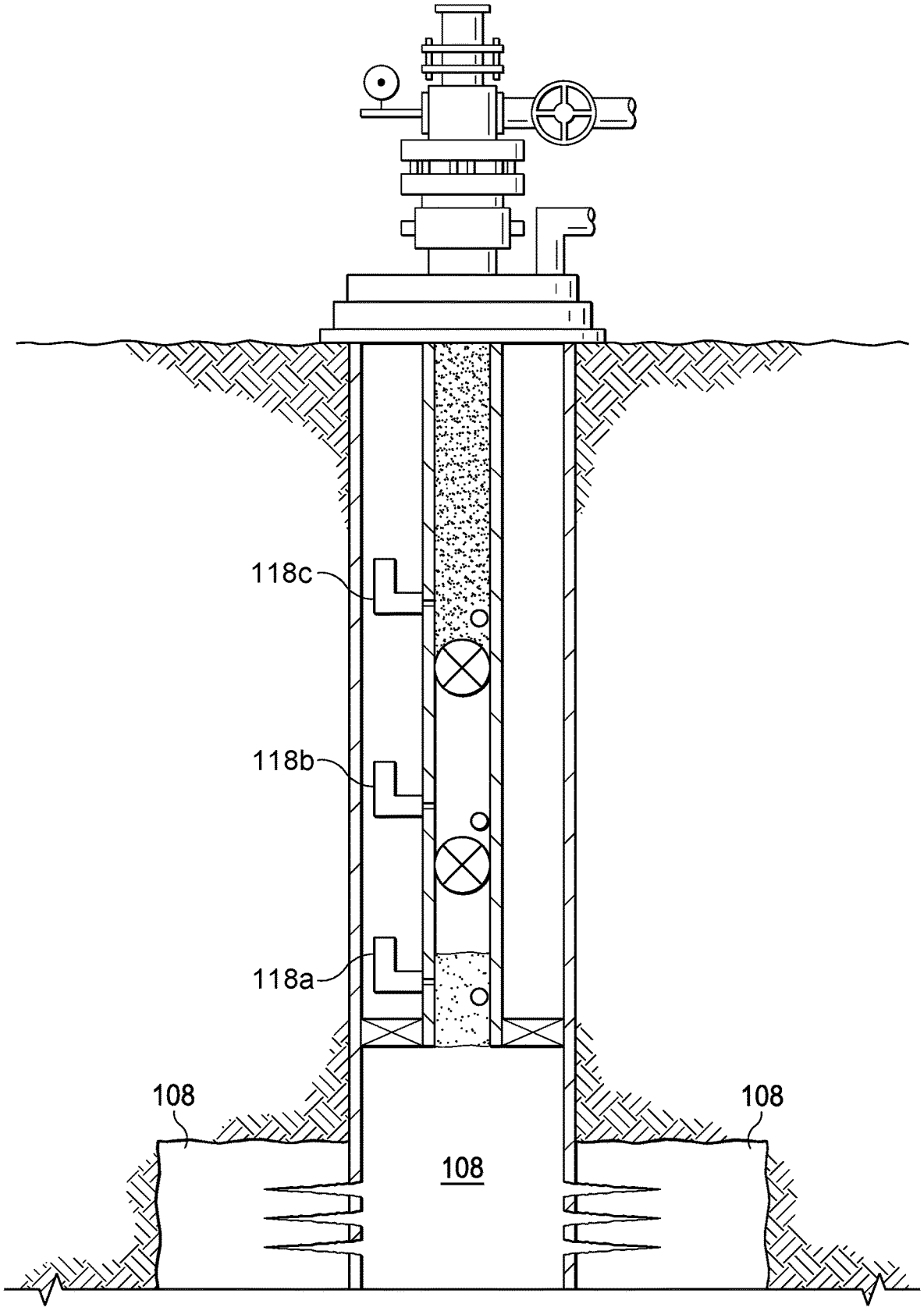
Figure 2G:
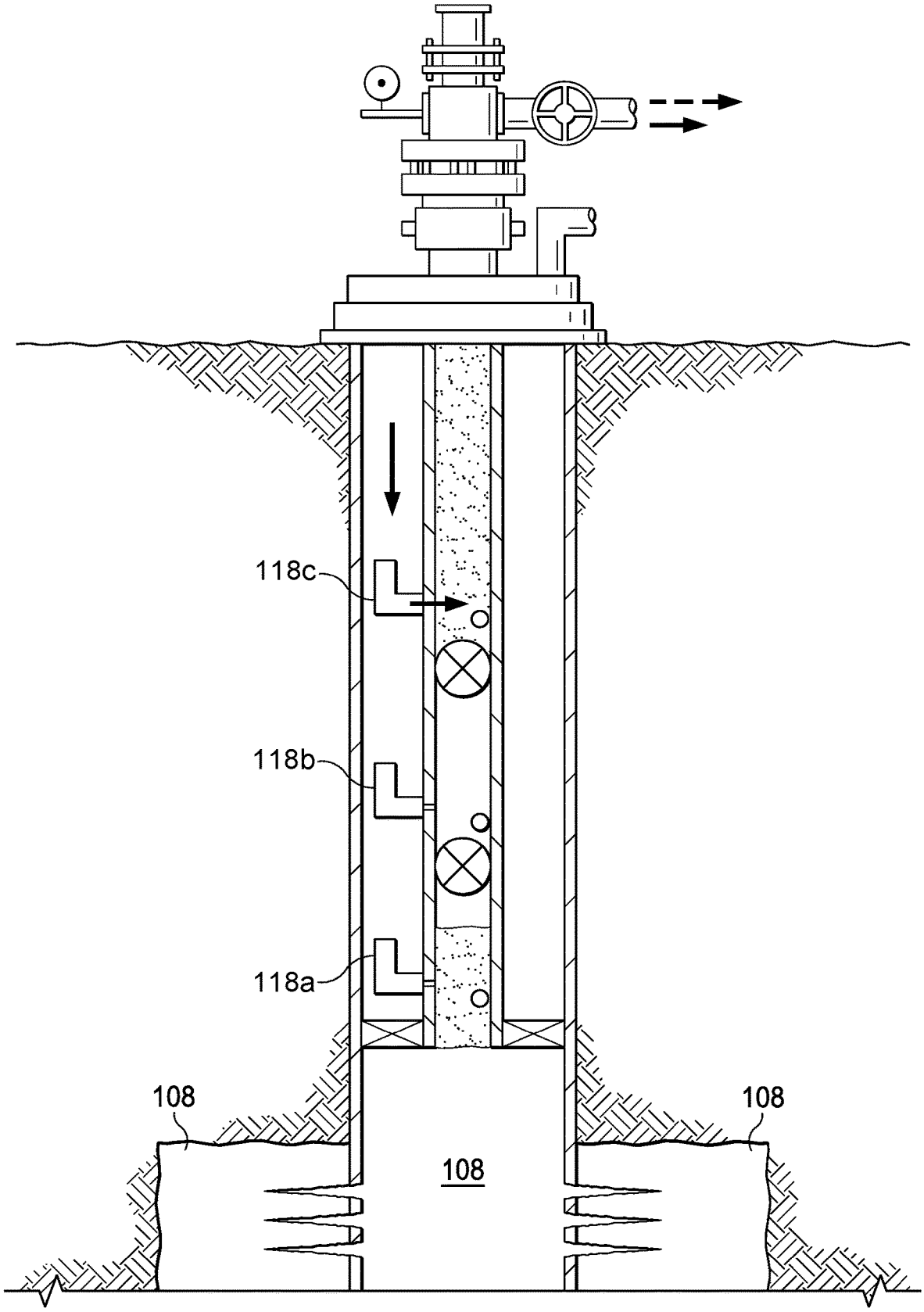
Figure 2H:
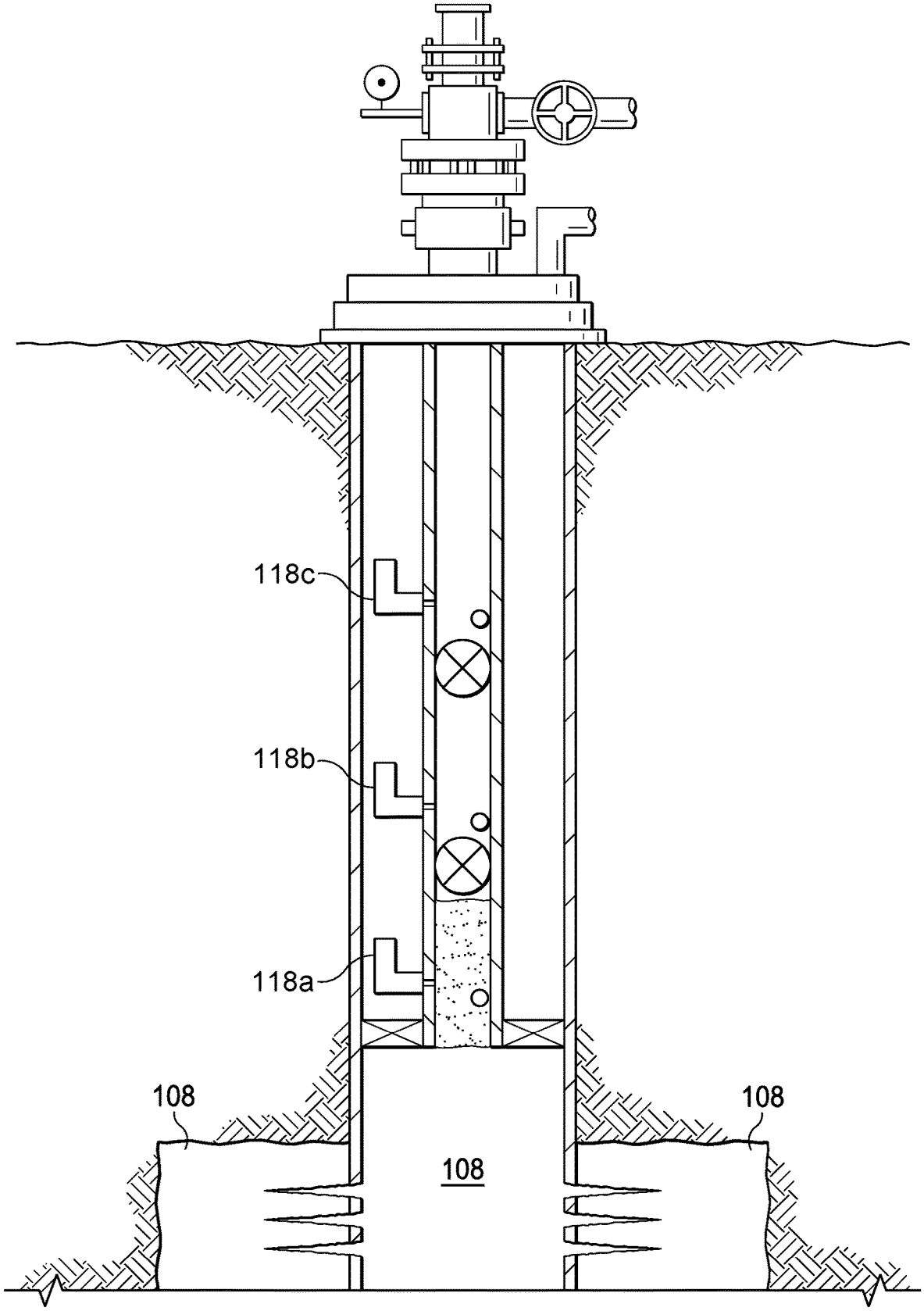

FIG. 2F shows hydrocarbons filled in the third stage. In the example wellbore tool system shown in FIG. 2F, the third stage is the most-uphole stage. FIG. 2G shows the hydrocarbons flowed uphole from the third stage to the surface, that is, out of the wellbore. FIG. 2H shows the hydrocarbons from the first stage having been lifted to the surface and out of the wellbore. FIG. 2H also shows that new hydrocarbons have flowed into and filled (completely or partially) into the first stage. The techniques described with reference to FIGS. 2A-2G are repeated to raise the hydrocarbons. In this manner, hydrocarbons are raised to the surface on a stage-by-stage basis.

In the example implementations described earlier, hydrocarbons were raised to the surface by injecting gas into only one stage at a time. That is, when gas was injected into the first stage, no gas was injected into the second or third stages. When gas was subsequently injected into the second stage, no gas was injected into the first or third stages. When gas was later injected into the third stage, no gas was injected into the first or second stages.

In some implementations, hydrocarbons can be raised to the surface by injecting gas into more than one stage at a time. For example, when the third stage is filled with hydrocarbons (FIG. 2F) and the controller determines that the first stage is filled with hydrocarbons, gas can be injected simultaneously into the first stage and the third stage. In such implementations, gas in more than one stage can be lifted simultaneously.

Figure 3:
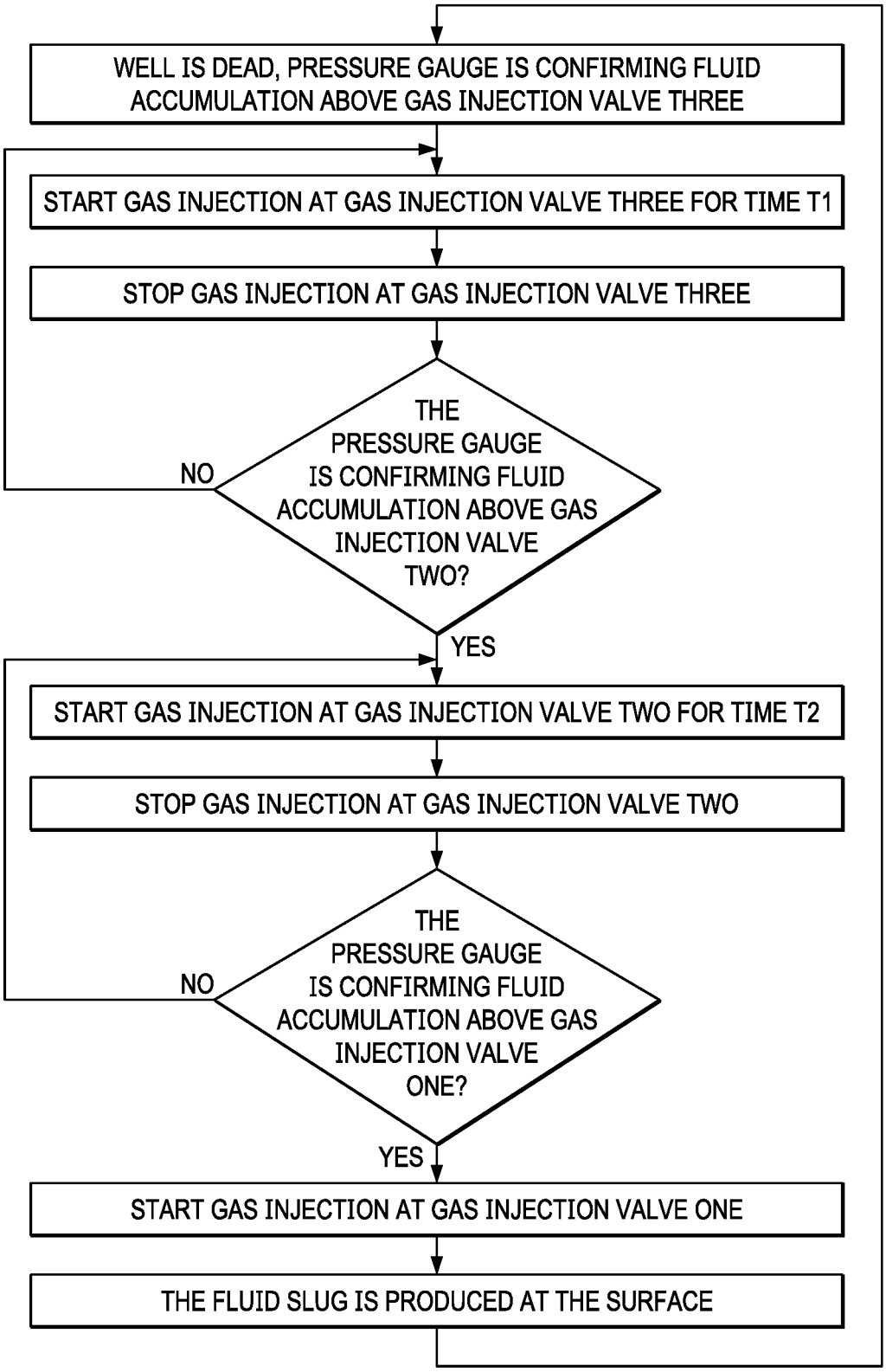
FIG. 3 is a flowchart of an example process to lift hydrocarbons.

FIG. 3 is a flowchart of an example process to lift hydrocarbons. The process can be implemented, for example, by the controller 126 described earlier. The process can be implemented when the well is dead, that is, the well has a low reservoir productivity index. In a first step, the controller determines that the first stage (that is, the most-downhole stage) is filled (completely or partially) with hydrocarbons from the subterranean zone. In a second step, the controller transmits a signal to inject gas into the first stage. For example, the controller can cause the gas to be injected for a time period sufficient to lift all the hydrocarbons in the first stage. In a third step, the controller stops injecting gas in the first stage. For example, the controller stops injecting the gas in the first stage after the time period or in response to pressure in the first stage falling below a threshold or pressure in the second stage increasing above a threshold (or any combination of them). In a fourth step, the controller checks if the second stage is filled with hydrocarbons. If not, then the controller continues to inject gas into the first stage. If yes, then, in a fifth step, the controller transmits a signal to inject gas into the second stage. In a sixth step, the controller stops injecting gas in the second stage. In a seventh step, the controller checks if a third stage is filled with hydrocarbons. If not, then the controller continues to inject gas into the second stage. If yes, then, in an eighth step, the controller transmits a signal to inject gas into the third stage. In a ninth step, the controller stops injecting gas in the third stage. Because the third stage is the most-uphole stage in this example, in a tenth step, the hydrocarbons that accumulated in the first stage are produced at the surface. The controller repeats the steps of the process to produce the next volume of hydrocarbons that have accumulated in the first stage.

What is claimed is:

1. A method comprising:

in a production tubing disposed in a wellbore formed in a subterranean zone, the production tubing extending from a surface of the wellbore to a downhole location in the wellbore at which hydrocarbons entrapped in the subterranean zone enter the wellbore, a plurality of valves disposed in the production tubing at a respective plurality of tubing locations, each valve configured to permit one-way flow of hydrocarbons in an uphole direction, wherein the plurality of valves divide the production tubing into a plurality of stages, a stage being a portion of the production tubing between two successively disposed valves:

(a) determining a presence of hydrocarbons in a first stage terminating at a first valve;

(b) in response to determining the presence of hydrocarbons in the first stage, injecting gas into the first stage causing the hydrocarbons in the first stage to flow uphole through the first valve into a second stage uphole of the first stage, the second stage terminating at a second valve;

(c) determining that the second stage is filled with the hydrocarbons flowed uphole through the first valve from the first stage; and (d) in response to determining that the second stage is filled with the hydrocarbons, ceasing to inject the gas into the first stage;

wherein a plurality of pressure gauges are disposed inside the production tubing in the respective plurality of stages, and determining the presence of hydrocarbons in the first stage comprises sensing, by at least one of 1) a first pressure gauge disposed in the first stage or 2) a second pressure gauge disposed in the second stage, a first fluidic pressure by the hydrocarbons in the first stage or a second fluidic pressure by the hydrocarbons in the second stage, respectively.

2. The method of claim 1, further comprising:

(e) in response to determining that the second stage is filled with the hydrocarbons, injecting gas directly into the production tubing at the second stage to mix the gas with the hydrocarbons, causing the hydrocarbons in the second stage to flow uphole through the second valve into a third stage uphole of the second stage, the third stage terminating at a third valve;

(f) determining that the third stage is filled with the hydrocarbons flowed uphole through the second valve from the second stage; and (g) in response to determining that the third stage is filled with the hydrocarbons, ceasing to inject the gas into the second stage.

3. The method of claim 1, wherein injecting the gas into the first stage comprises injecting the gas for a first duration of time sufficient to flow the hydrocarbons in the first stage uphole through the first valve into the second stage.

4. The method of claim 1, wherein determining that the second stage is filled with the hydrocarbons flowed uphole through the first valve from the first stage comprises determining a presence of hydrocarbons in a third stage uphole of the second stage and terminating at a third valve.

5. The method of claim 4, wherein a pressure gauge is disposed in the third stage uphole of the second valve, and wherein determining the presence of hydrocarbons in the third stage comprises sensing, by the pressure gauge disposed in the third stage, a fluidic pressure caused by hydrocarbons flowed from the second stage through the second valve into the third stage.

6. The method of claim 1, further comprising repeating steps (a), (b), (c) and (d) until the hydrocarbons in the first stage are flowed out of the wellbore at the surface.

7. The method of claim 1, wherein the second pressure gauge is disposed adjacent an entrance of the second stage and near the first valve, and determining the presence of hydrocarbons in the first stage comprises:

sensing, by the second pressure gauge, the second fluidic pressure of hydrocarbons in the second stage for a predetermined period of time; and determining that the second fluidic pressure at the second stage satisfies a fluidic pressure threshold representative of a fluidic pressure that indicates that the first stage is filled and a portion of hydrocarbons has leaked into the second stage.

8. The method of claim 1, wherein the determining the presence of hydrocarbons in the first stage comprises:

sensing, by the first pressure gauge, the first fluidic pressure of hydrocarbons in the first stage for a predetermined period of time; and determining that the first fluidic pressure at the first stage satisfies a fluidic pressure threshold representative of a fluidic pressure that indicates that the first stage is filled completely or partially with hydrocarbons.

9. A wellbore tool system comprising:

a production tubing disposed in a wellbore formed in a subterranean zone, the production tubing extending from a surface of the wellbore to a downhole location in the wellbore at which hydrocarbons entrapped in the subterranean zone enter the wellbore;

a plurality of valves disposed in the production tubing at a respective plurality of tubing locations, each valve configured to permit one-way flow of hydrocarbons in an uphole direction, wherein the plurality of valves divide the production tubing into a plurality of stages, a stage being a portion of the production tubing between two successively disposed valves;

a plurality of pressure gauges disposed inside the production tubing, each pressure gauge disposed in a respective stage and configured to sense a fluidic pressure by the hydrocarbons in the respective stage;

a plurality of gas injection valves coupled to the production tubing, each gas injection valve disposed in a respective stage; and a controller coupled to the plurality of valves and the plurality of gas injection valves, the controller configured to transmit signals, based on fluidic pressures sensed by the plurality of pressure gauges, to the plurality of gas injection valves to lift hydrocarbons flowed into the wellbore at the downhole location to the surface on a stage-by-stage basis.

10. The wellbore tool system of claim 9, wherein, to lift the hydrocarbons to the surface on a stage-by-stage basis, the controller is configured to perform operations comprising:

(a) determining, based on pressure information received from at least one of 1) a first pressure gauge residing at a first stage terminating at a first valve of the plurality of valves or 2) a second pressure gauge residing at a second stage extending from the first valve to a second valve of the plurality of valves, a presence of hydrocarbons in the first stage;

(b) in response to determining the presence of hydrocarbons in the first stage, injecting gas directly into the production tubing at the first stage to mix the gas with the hydrocarbons, causing the hydrocarbons in the first stage to flow uphole through the first valve into the second stage uphole of the first stage, the second stage terminating at the second valve;

(c) determining that the second stage is filled with the hydrocarbons flowed uphole through the first valve from the first stage; and (d) in response to determining the presence of hydrocarbons in the second stage, ceasing to inject gas into the first stage.

11. The wellbore tool system of claim 10, wherein determining the presence of hydrocarbons in the first stage comprises:

1) receiving, by the controller and from the first pressure gauge, a first fluidic pressure by the hydrocarbons in the first stage, the pressure information comprising the first fluidic pressure; and 2) receiving, by the controller and from the second pressure gauge, a second fluidic pressure by the hydrocarbons in the second stage, the pressure information comprising the second fluidic pressure.

12. The wellbore tool system of claim 10, wherein injecting the gas into the first stage comprises injecting the gas for a first duration of time sufficient to flow the hydrocarbons in the first stage uphole through the first valve into the second stage.

13. The wellbore tool system of claim 10, wherein determining that the second stage is filled with the hydrocarbons flowed uphole through the first valve from the first stage comprises determining a presence of hydrocarbons in a third stage uphole of the second stage and terminating at a third valve.

14. The wellbore tool system of claim 13, wherein a pressure gauge is disposed in the third stage uphole of the second valve, and wherein determining the presence of hydrocarbons in the third stage comprises sensing, by the pressure gauge disposed in the third stage, a fluidic pressure caused by hydrocarbons flowed from the second stage through the second valve into the third stage.

15. The wellbore tool system of claim 10, wherein the controller is configured to perform operations comprising repeating steps (a), (b), (c) and (d) until the hydrocarbons in the first stage are flowed out of the wellbore at the surface.

16. A method comprising:

in a production tubing disposed in a wellbore formed in a subterranean zone, the production tubing extending from a surface of the wellbore to a downhole location in the wellbore at which hydrocarbons entrapped in the subterranean zone enter the wellbore, a plurality of valves disposed in the production tubing at a respective plurality of tubing locations, each valve configured to permit one-way flow of hydrocarbons in an uphole direction, wherein the plurality of valves divide the production tubing into a plurality of stages, a stage being a portion of the production tubing between two successively disposed valves, determining, based on a fluidic pressure of hydrocarbons sensed by a first pressure gauge disposed in the production tubing at a first stage of the plurality of stages, that the hydrocarbons are carried by the first stage;

injecting gas into the first stage causing the hydrocarbons to flow into a second stage uphole of the first stage;

ceasing to inject the gas into the first stage in response to determining that the hydrocarbons flowed to the second stage; and after ceasing to inject the gas into the first stage, injecting gas into the second stage causing the hydrocarbons to flow into a third stage uphole of the second stage.

17. The method of claim 16, further comprising, before ceasing to inject gas into the first stage, determining, by at least one of 1) a second pressure gauge disposed in the second stage or 2) a third pressure gauge disposed in the third stage, a second fluidic pressure by the hydrocarbons in the second stage or a third fluidic pressure by the hydrocarbons in the third stage, respectively.

18. The method of claim 16, further comprising preventing a flow back of the hydrocarbons from the second stage to the first stage after ceasing to inject the gas into the first stage.

19. The method of claim 18, wherein a first valve at which the first stage terminates prevents the flow back of the hydrocarbons from the second stage to the first stage.

20. The method of claim 16, further comprising injecting gas into the plurality of stages on a stage-by-stage basis to flow the hydrocarbons to the surface of the wellbore.

* * * * *